US005782146A

United States Patent [19]

Lin

[11] Patent Number: 5,782,146

[45] Date of Patent: Jul. 21, 1998

[54] RATCHET SCREW DRIVER

[76] Inventor: Ching Chou Lin, No. 150, Sec. 3, Chung San Road, Wu Zh Hsiang, Taichung Hsien, Taiwan

[21] Appl. No.: 802,093

[22] Filed: Feb. 19, 1997

[51] Int. Cl.[6] ..... B25B 13/46

[52] U.S. Cl. ..... 81/58.3; 81/177.4; 81/490; 192/48.92

[58] Field of Search ..... 81/58, 58.1, 58.3, 81/58.4, 60, 63.1, 177.4, 490, 437–439; 192/43, 45.2, 46, 48.1, 48.92

[56] References Cited

U.S. PATENT DOCUMENTS 122,916 1/1872 Sanborn ..... 81/58.3

1,627,441 5/1927 Lawyer ..... 81/58.3

2,292,228 8/1942 Krieger ..... 81/58.3

*Primary Examiner*—D. S. Meislin

*Attorney, Agent, or Firm*—Charles F. Baxley, Esq.

[57] ABSTRACT

A ratchet screw driver includes two rings secured in a handle and each having a number of ratchet teeth opposite to each other. A barrel is rotatably engaged in the rings. Two followers are slidably engaged on the barrel and rotated in concert with the barrel and each includes a number of ratchet teeth for engaging with that of the rings. A spring may bias the followers toward the rings. An extension is engaged with the barrel and may be rotated in an active direction by the handle. The followers are forced toward each other when the handle is rotated in a reverse direction.

4 Claims, 6 Drawing Sheets

RATCHET SCREW DRIVER

BACKGROUND OF THE INVENTION

1. Field of the Invention

The present invention relates to a screw driver, and more particularly to a ratchet screw driver.

2. Description of the Prior Art

Typical screw drivers comprise a driving shaft engaged in a handle for driving fasteners. A number of ratchet mechanisms are engaged in the handle for allowing the driving shaft to be rotated in an active direction and to be rotated freely in the opposite direction. However, the ratchet mechanism includes a complicated configuration. In addition, the tool bits may not be received in the handle in which the ratchet mechanism is engaged therein.

The present invention has arisen to mitigate and/or obviate the afore-described disadvantages of the conventional screw drivers.

SUMMARY OF THE INVENTION

The primary objective of the present invention is to provide a ratchet screw driver in which the driving shaft and the tool bits may be engaged in the handle where the ratchet mechanism is also received.

In accordance with one aspect of the invention, there is provided a ratchet screw driver comprising a handle including a bore and including a front portion and including a rear portion, two rings engaged in the front portion and the rear portion of the handle respectively and rotated in concert with the handle, the rings each including a plurality of ratchet teeth, the ratchet teeth of a first of the rings being arranged opposite to that of a second of the rings, a barrel rotatably engaged in the rings and including a non-circular middle portion, two followers slidably engaged on the middle portion of the barrel and rotated in concert with the barrel, the followers each including a plurality of ratchet teeth for engaging with the ratchet teeth of the rings respectively, means for biasing the followers toward the rings, and an extension engaged with the barrel. The extension is adapted to be rotated by the handle when the handle is rotated in an active direction, and the followers are forced toward each other against the biasing means when the handle is rotated in a reverse direction.

The barrel includes two ends each having at least one resilient blade for engaging with the extension and for retaining the extension in place.

The handle includes an open front and includes a cap secured to the front portion, the cap includes at least one cavity for engaging with a tool bit.

A member is further secured in the front portion of the handle and the first ring is secured to the member and rotated in concert with the member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
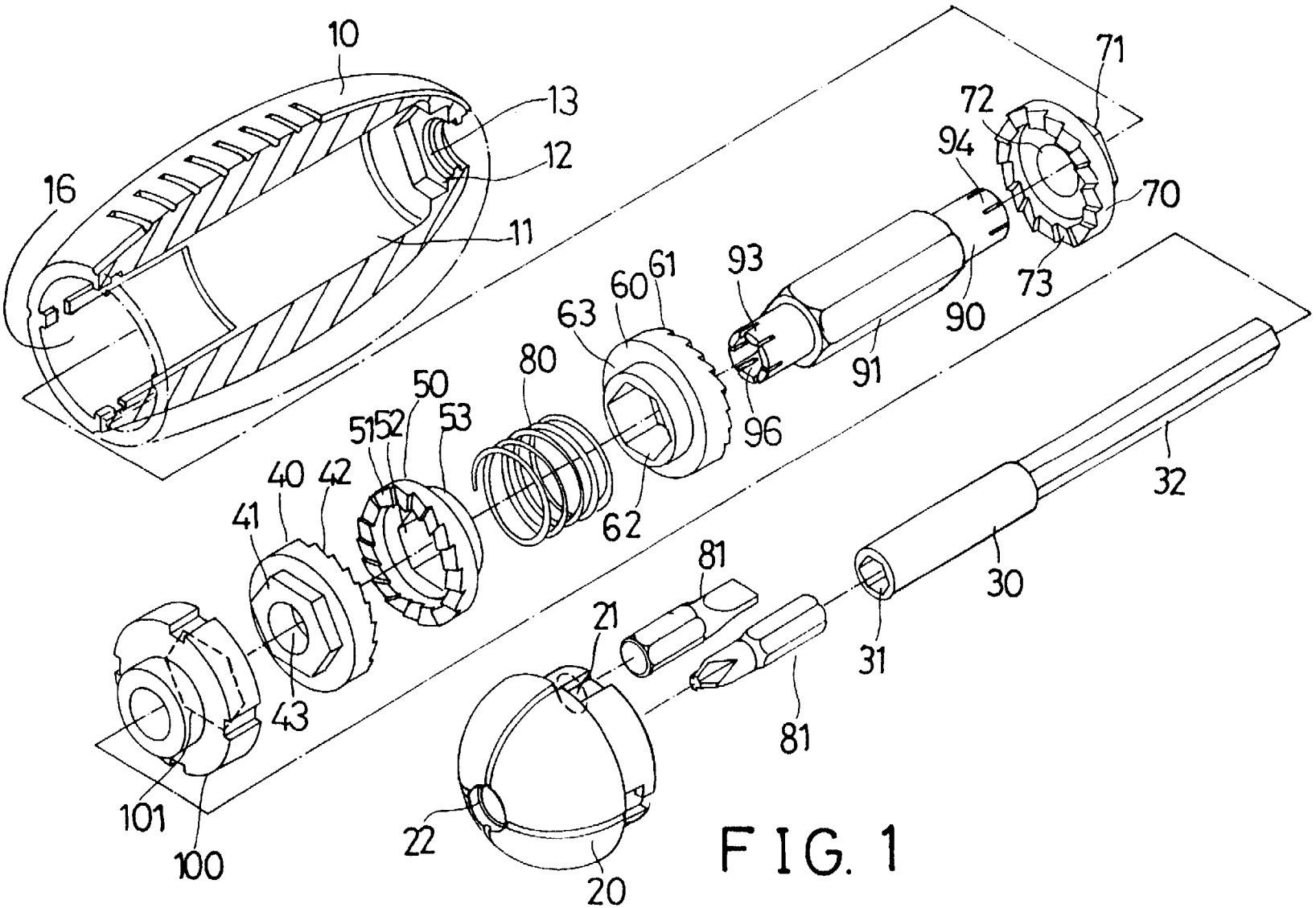
FIG. 1 is an exploded view of a ratchet screw driver in accordance with the present invention.
Figure 2:
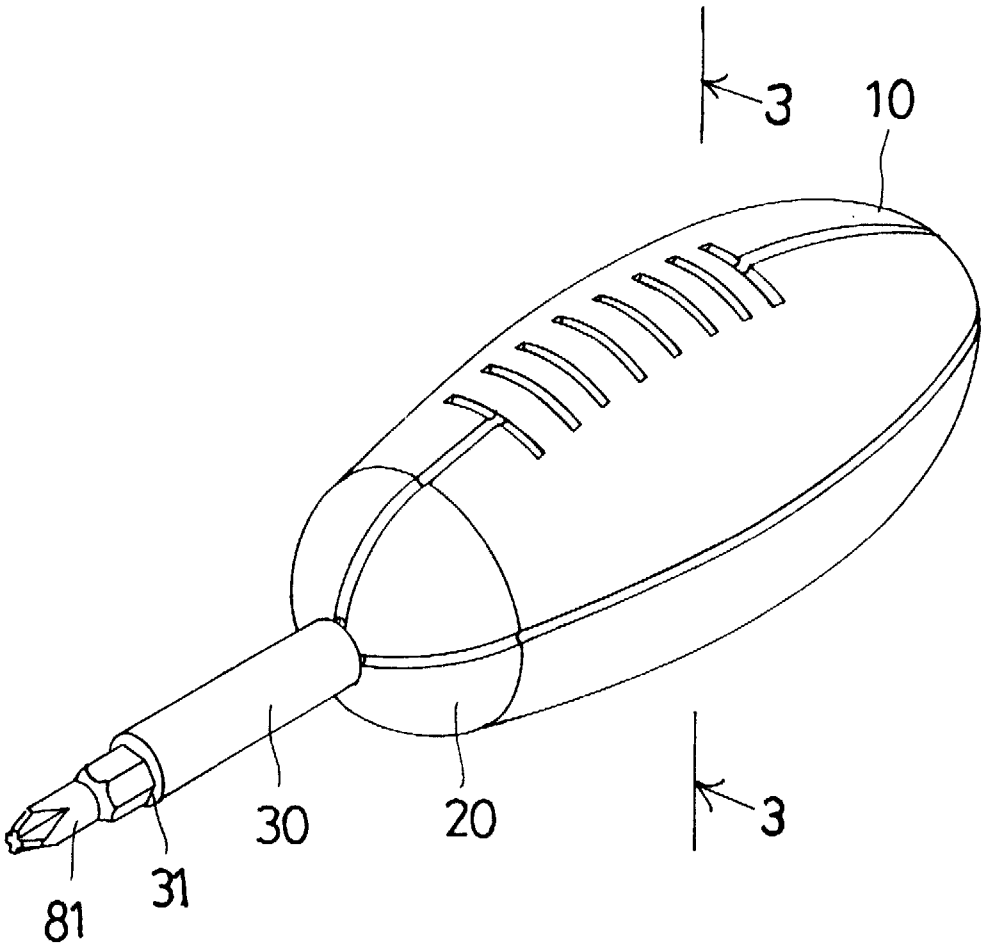
FIG. 2 is a perspective view of the ratchet screw driver.
Figure 3:
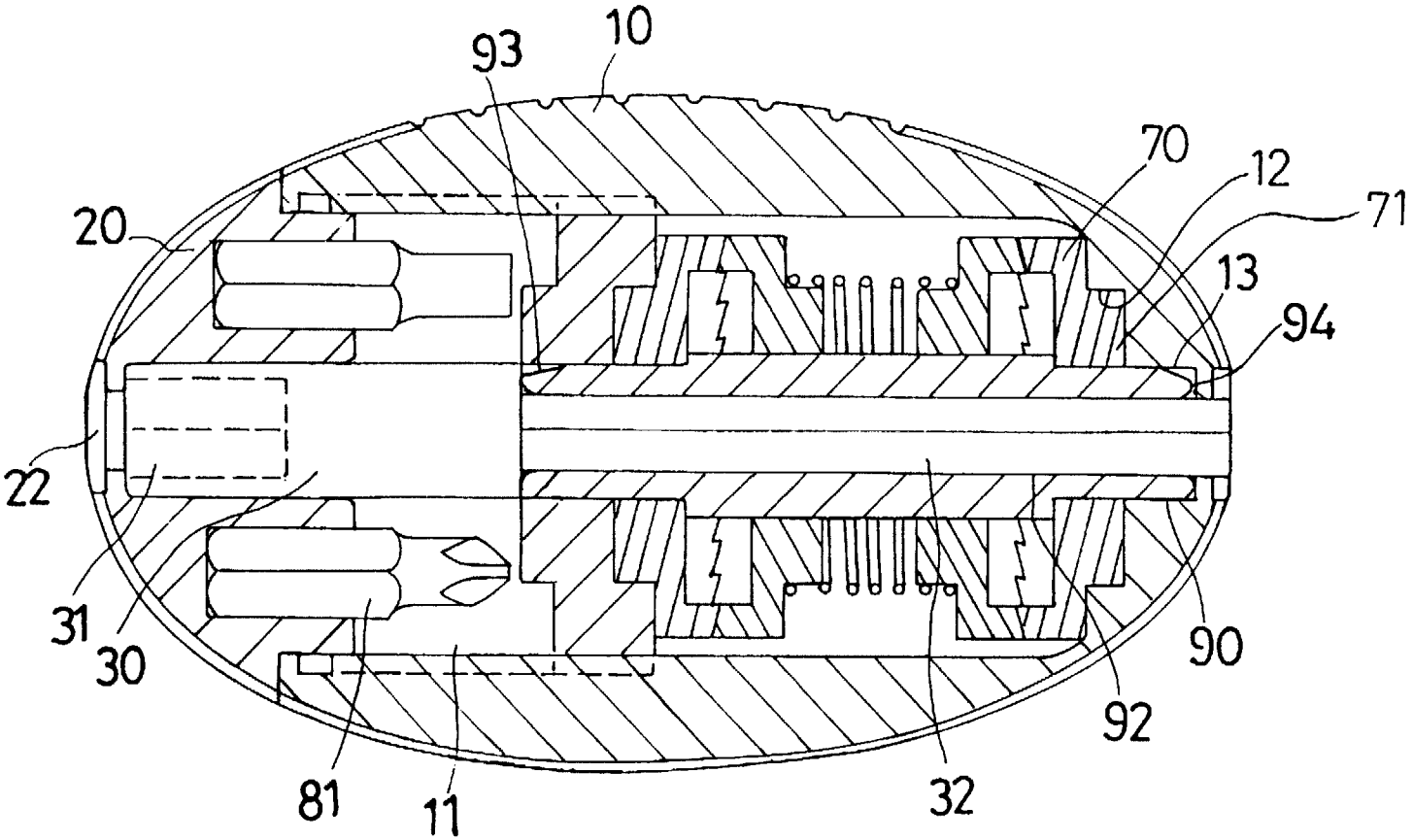
FIGS. 3, 4, 5, 6 are cross sectional views illustrating the operation of the ratchet screw driver.

Referring to the drawings, and initially to FIGS. 1 to 3, a ratchet screw driver in accordance with the present invention comprises a handle 10 including a bore 11 and including an open front 16 and including an orifice 13 formed in the rear portion and including a non-circular hole 12 formed in the rear portion. A cap 20 may be secured to the front portion of the handle 10 for enclosing the open front 16. The cap 20 includes a number of cavities 21 for engaging with tool bits 81 and for allowing the tool bits 81 to be engaged in the bore 11 of the handle 10. The cap 20 includes an orifice 22 formed in the center portion.

A member 100 is secured in the front portion of the handle 10 and includes a non-circular hole 101. Two rings 70, 40 are engaged in the bore 11 of the handle 10 and each includes a non-circular bulge 71, 41 for engaging with the non-circular holes 12, 101 of the handle 10 and of the member 100 such that the rings 40, 70 rotate in concert with the handle 10. The rings 40, 70 each includes a number of ratchet teeth 42, 73 facing toward that of the other ring and each includes a bore 43, 72. The directions of the ratchet teeth 42, 73 are opposite to each other. A barrel 90 includes two ends rotatably engaged in the bores 43, 72 of the rings 40, 70 and includes a middle portion 91 having a non-circular cross section. The barrel 90 includes a non-circular bore 96 for engaging with a shaft 32 of an extension 30 which includes an opening 31 for engaging with a tool bit 81. The ends of the barrel 90 each includes a number of resilient blades 93, 94 for resiliently retaining the shaft 32 in place.

Two followers 50, 60 each includes a non-circular bore 52, 62 for engaging with middle portion 91 of the barrel 90 such that the followers 50, 60 may slide along the barrel 90 and may rotate in concert with the barrel 90. The followers 50, 60 each includes a number of ratchet teeth 51, 61 for engaging with the ratchet teeth 42, 73 of the rings 40, 70. A spring 80 is engaged on the hubs 53, 63 of the followers 50, 60 for biasing the ratchet teeth 51, 61 to engage with the ratchet teeth 42, 73.

Figure 4:
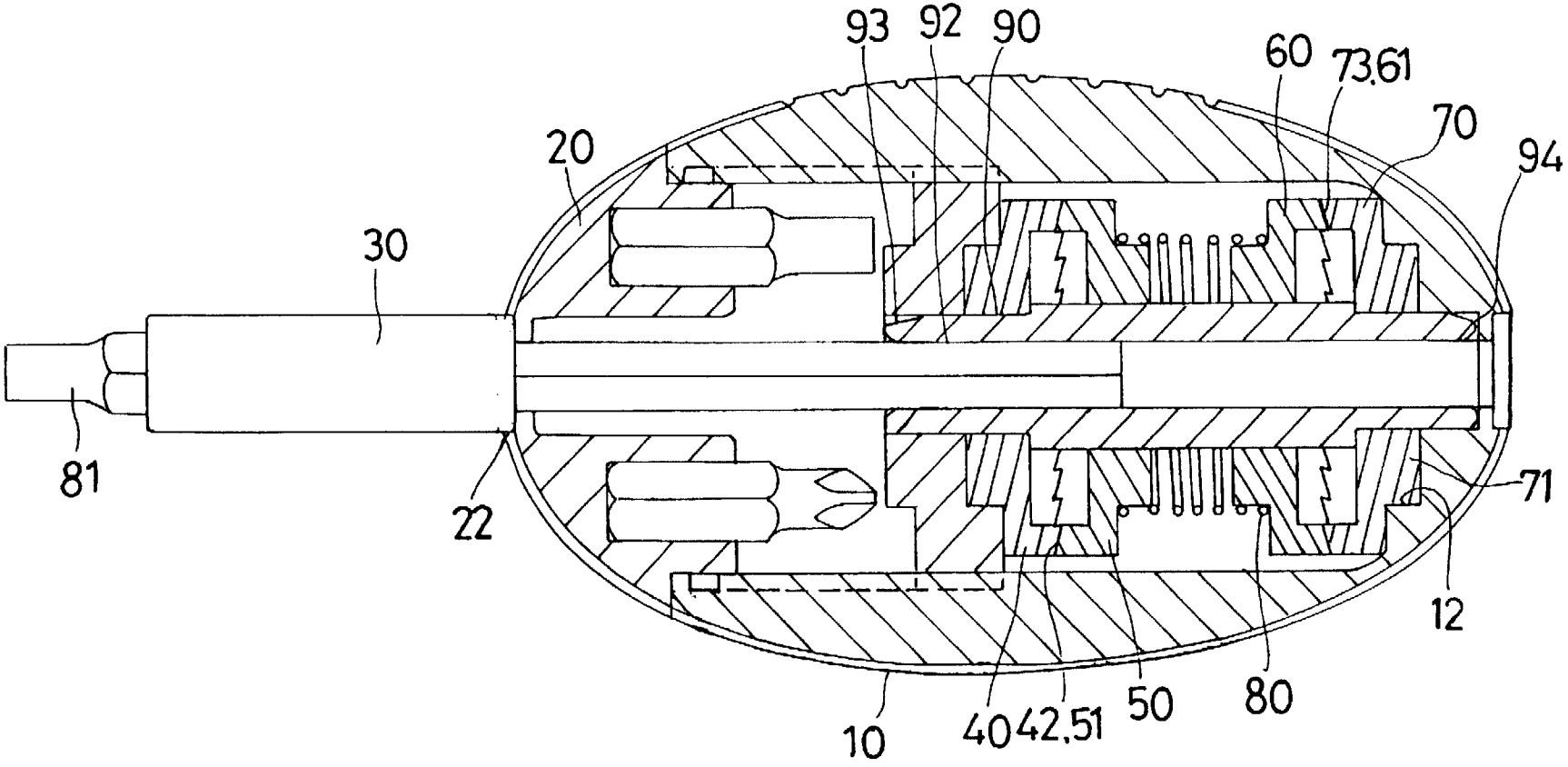
Figure 5:
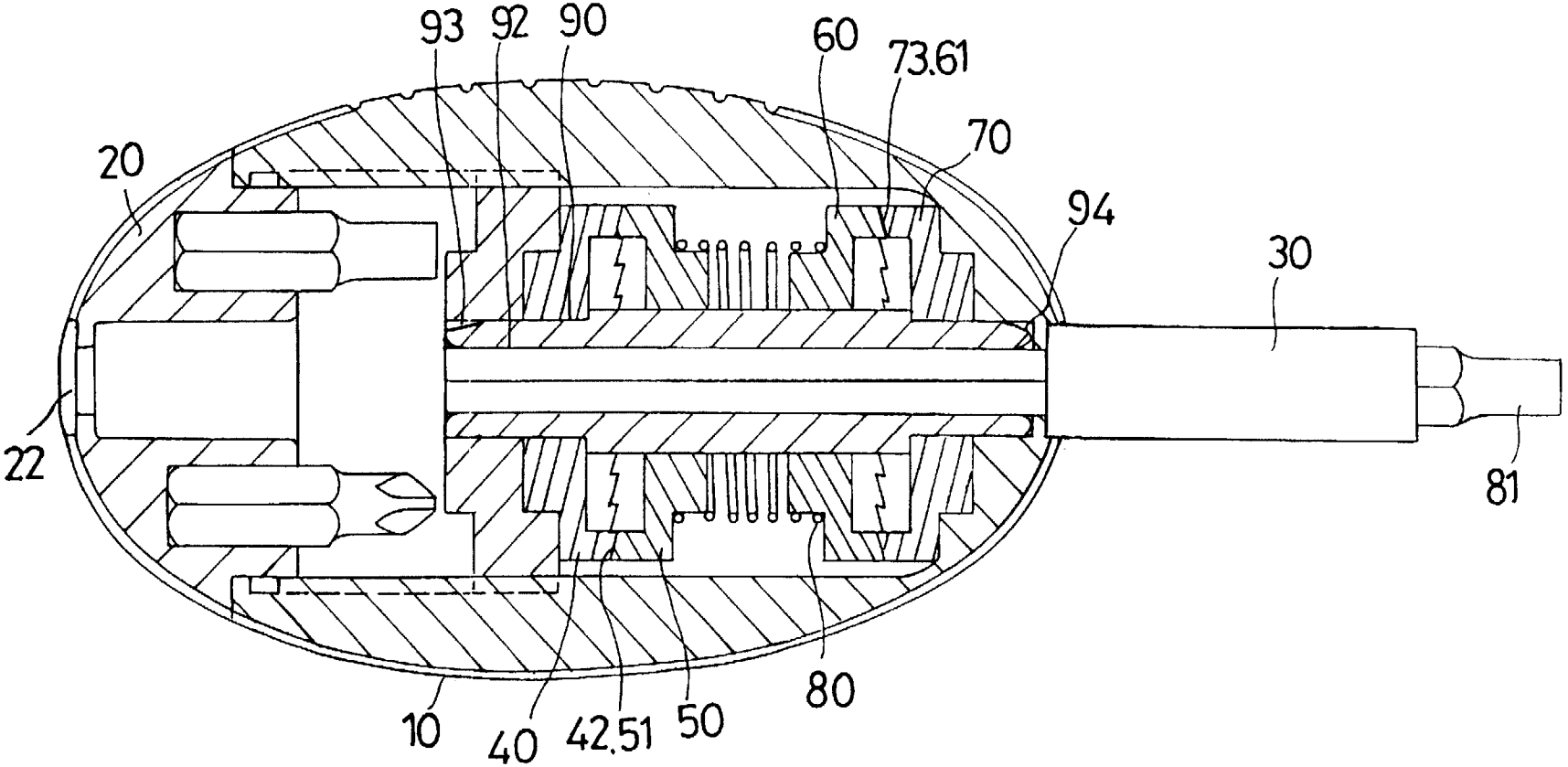
Figure 6:
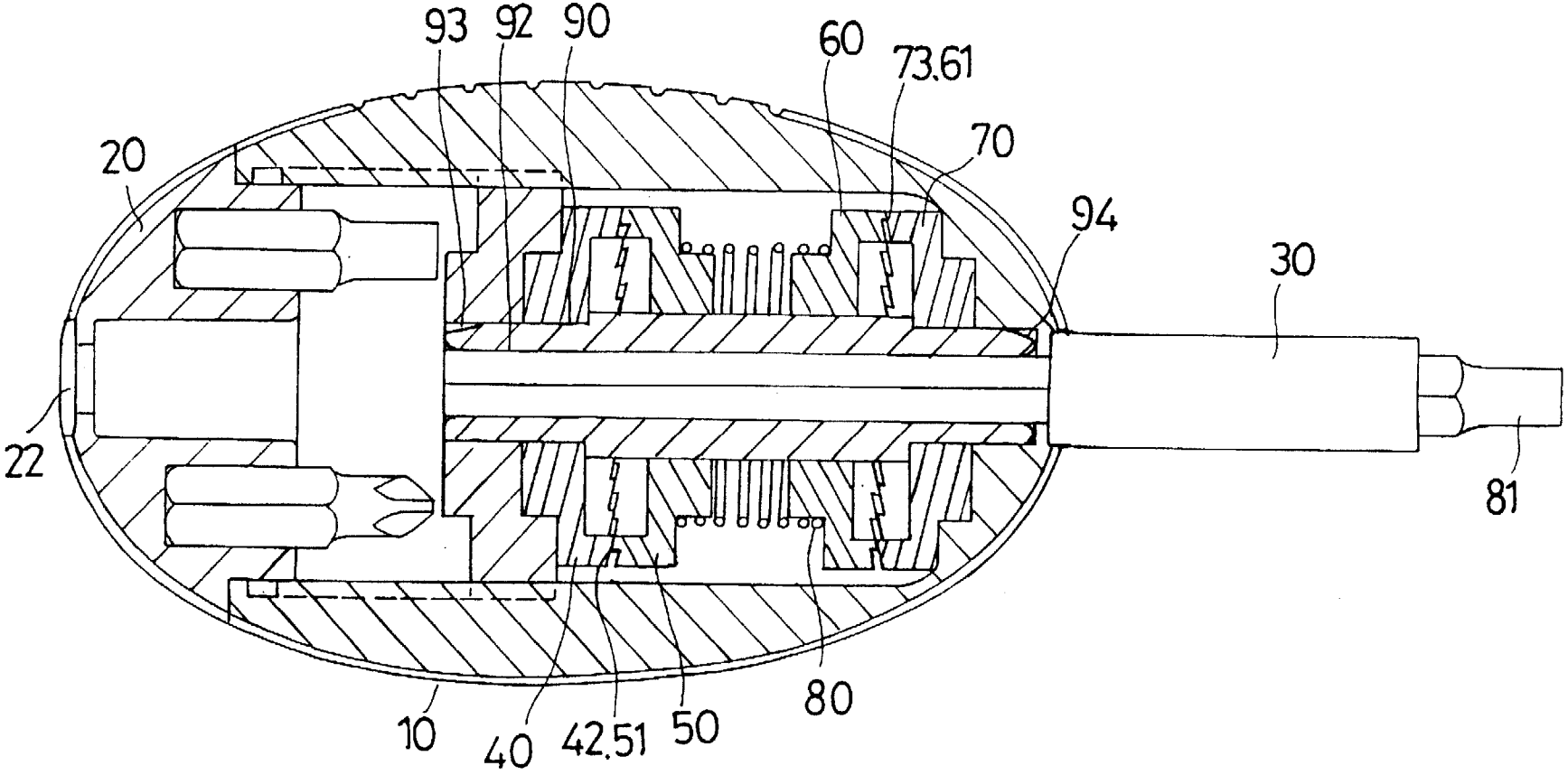

In operation, as shown in FIGS. 5 and 6, the shaft 32 of the extension 30 may engage with the barrel 90 via the orifice 13 of the handle 10. When the handle 10 is rotated in one direction, the shaft 32 may be rotated by the handle 10. However, the followers 50, 60 may be forced toward each other against the spring 80 when the handle is rotated in the reverse direction such that the shaft 32 may not be rotated by the handle. As shown in FIG. 4, when the shaft 32 is engaged with the barrel 90 via the orifice 22 of the cap 20, the active driving direction of the shaft 32 is different from that shown in FIGS. 5 and 6. As shown in FIG. 3, the extension 30 may be received in the handle 10 so as to form a compact configuration.

Accordingly, the ratchet screw driver in accordance with the present invention includes a driving shaft and a number of tool bits that may be engaged in the handle where the ratchet mechanism is received.

Although this invention has been described with a certain degree of particularity, it is to be understood that the present disclosure has been made by way of example only and that number changes in the detailed construction and the combination and arrangement of parts may be resorted to without departing from the spirit and scope of the invention as hereinafter claimed.

I claim:

1. A ratchet screw driver comprising:

a handle including a bore and including a front portion and including a rear portion, two rings engaged in said front portion and said rear portion of said handle respectively and rotated in concert with said handle, said rings each including a plurality of ratchet teeth, said ratchet teeth of a first of said rings being arranged opposite to that of a second of said rings, a barrel rotatably engaged in said rings and including a non-circular middle portion, two followers slidably engaged on said middle portion of said barrel and rotated in concert with said barrel, said followers each including a plurality of ratchet teeth for engaging with said ratchet teeth of said rings respectively, means for biasing said followers toward said rings, and an extension engaged with said barrel, said extension being adapted to be rotated by said handle when said handle is rotated in an active direction, and said followers being forced toward each other against said biasing means when said handle is rotated in a reverse direction.

2. A ratchet screw driver according to claim 1, wherein said barrel includes two ends each having at least one resilient blade for engaging with said extension and for retaining said extension in place.

3. A ratchet screw driver according to claim 1, wherein said handle includes an open front and includes a cap secured to said front portion, said cap includes at least one cavity for engaging with a tool bit.

4. A ratchet screw driver according to claim 1 further comprising a member secured in said front portion of said handle, said first ring being secured to said member and rotated in concert with said member.

* * * * *